US009555919B2

(12) United States Patent
Gessler, Jr. et al.

(10) Patent No.: US 9,555,919 B2
(45) **Date of Patent: *Jan. 31, 2017**

(54) CONVERTIBLE PACKAGE ASSEMBLY AND DISPLAY SYSTEM

(71) Applicant: Delkor Systems, Inc., St. Paul, MN (US)

(72) Inventors: Richard J. Gessler, Jr., Stillwater, MN (US); Kevin B. Weiss, Stillwater, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/862,755

(22) Filed: Sep. 23, 2015

(65) Prior Publication Data

US 2016/0009441 A1 Jan. 14, 2016

Related U.S. Application Data

(63) Continuation of application No. 14/255,320, filed on Apr. 17, 2014, now Pat. No. 9,187,207.

(60) Provisional application No. 61/869,117, filed on Aug. 23, 2013.

(51) Int. Cl.

| | |
|---|---|
| ***B65D 5/52*** | (2006.01) |
| ***B65D 5/54*** | (2006.01) |
| ***B31B 1/26*** | (2006.01) |
| ***B65D 5/468*** | (2006.01) |
| ***B65D 5/42*** | (2006.01) |

(52) U.S. Cl.

CPC . *B65D 5/54* (2013.01); *B31B 1/26* (2013.01); *B65D 5/4266* (2013.01); *B65D 5/4608* (2013.01); *B65D 5/52* (2013.01); *B65D 5/5445* (2013.01)

(58) Field of Classification Search

CPC ..... B65D 5/0227; B65D 5/5445; B65D 5/52

USPC ..... 206/45.21, 467, 469; 220/738, 774, 235

See application file for complete search history.

(56) References Cited

U.S. PATENT DOCUMENTS

| | | | | |
|---|---|---|---|---|
| 4,058,206 A | | 11/1977 | Morse et al. | |
| 4,553,666 A | * | 11/1985 | Gullikson | B65D 5/5445 229/112 |
| 5,582,345 A | * | 12/1996 | Lankhuijzen | B65D 5/5445 229/235 |
| 5,657,872 A | | 8/1997 | Leftwich et al. | |

(Continued)

FOREIGN PATENT DOCUMENTS

| | | |
|---|---|---|
| GB | 2437514 | 10/2007 |
| JP | 4866933 | 8/1973 |
| WO | 2012145515 | 10/2012 |

OTHER PUBLICATIONS

PCT International Search Report, PCT International Application No. PCT/US2014/034492 (Filing date: Apr. 17, 2014), mailed Sep. 11, 2014; 5 pages.

(Continued)

*Primary Examiner* — King M Chu

(74) *Attorney, Agent, or Firm* — Beck Tysver Evans, PLLC

(57) ABSTRACT

A package assembly suitable for use in storing and shipping a plurality of product containers includes a shipping configuration and a display configuration. In the shipping configuration the package assembly is constructed from a single blank of packaging material and formed into a case into which a plurality of product containers are inserted. In the display configuration a top portion of the case is removed from a bottom portion of the case along one or more tear lines on the blank.

6 Claims, 14 Drawing Sheets

(56) References Cited

U.S. PATENT DOCUMENTS

| | | | | |
|---|---|---|---|---|
| 5,887,717 | A | 3/1999 | Anderson et al. | |
| 6,168,027 | B1 | 1/2001 | Esser | |
| 6,464,131 | B1 * | 10/2002 | Blazevich | B65D 5/52 229/112 |
| 6,478,159 | B1 * | 11/2002 | Taylor | B65D 5/542 206/738 |
| 6,510,982 | B2 * | 1/2003 | White | A47F 5/112 206/736 |
| 6,588,594 | B2 | 7/2003 | Andersen et al. | |
| 7,370,761 | B2 | 5/2008 | Andersen et al. | |
| 7,451,878 | B2 | 11/2008 | Rochefort et al. | |
| 8,474,688 | B2 | 7/2013 | Cameron | |
| 2003/0150747 | A1 * | 8/2003 | Maus | B65D 5/5445 206/192 |
| 2004/0222127 | A1 * | 11/2004 | McLeod | B65D 5/4204 206/736 |
| 2005/0184139 | A1 * | 8/2005 | Gasior | B65D 5/0227 229/240 |

OTHER PUBLICATIONS

PCT Written Opinion of the International Searching Authority, PCT International Application No. PCT/US2014/034492 (Filing Date: Apr. 17, 2014), mailed Sep. 11, 2014; 6 pages.

* cited by examiner

CONVERTIBLE PACKAGE ASSEMBLY AND DISPLAY SYSTEM

CROSS REFERENCE TO RELATED APPLICATIONS

The present application is a continuation application of U.S. application Ser. No. 14/255,320 (published as U.S. Publication Number 2015/0053587), filed on Apr. 17, 2014 and titled Convertible Package Assembly and Display System and claims priority therefrom as well as from provisional application No. 61/869,117 which was filed on Aug. 23, 2013. The entire contents of each of which being incorporated herein by reference.

BACKGROUND OF THE INVENTION

Field of the Invention

The present invention relates to a unique package assembly suitable for use in storing and shipping a plurality of product containers, and which is convertible to a shelf-ready product display by simply removing and discarding a section of the original assembly that is designed for easy removal therefrom.

Description of the Related Art

Shipping packages, such as corrugated, cardboard and/or paperboard boxes, trays and similar assemblies are commonly used to contain a plurality of products or product containers for transport of such products from the manufacturer, to their eventual retail environment. Upon arrival in a retail environment it is desirable to store or display these products on shelves so that the goods and products are conveniently visible and accessible by a user. Thus, some package assemblies have been designed to be convertible from a shipping configuration to a display configuration (shelf ready packaging).

For example, U.S. Pat. No. 7,451,878 to Rochefort et al. discloses package assemblies that are convertible to displays. One assembly described therein is formed of an outer wrap portion and an internal divider/structural support portion. Openings are provided in the face panel of the container. Zipper pull tabs are also provided in the side face panels so that the face panel and the top half of the outer wrap portion may be removed to convert the package assembly into a dispensing container or a tray.

Another shipping/display assembly is disclosed in U.S. Pat. No. 5,657,872 to Leftwich et al., issued Aug. 19, 1997. The disclosed package assembly has a tray portion and a cover portion. The front side panel of the tray portion has a severable portion, which may be removed to allow products be extracted from the resulting opening. U.S. Pat. No. 6,168,027 to Esser, issued Jan. 2, 2001, discloses a shipping/display box having a tear-out segment spaced from all eight corners of the box. The tear-out segment can be removed at a store for display.

Some packaging assemblies available from Delkor Systems Inc. are described in U.S. Pat. Nos. 5,887,717; 6,588,594; and 7,370,761 and include package assemblies having product support members with tapered sides and substantially open fronts (with or without a lip) which allows the support members to be shelf ready upon removal of a shrink wrap and/or top pad upon arrival of the package assembly in a retail environment.

Each of the above referenced U.S. patents and any and all patents, applications and/or all other published documents mentioned anywhere in this application are incorporated herein by reference in their entirety.

Despite the plethora of unique convertible package assembly/display systems that are available, there remains a need for improved systems that are even more dynamically useful, environmentally friendly and cost effective.

SUMMARY OF THE INVENTION

Embodiments of the present disclosure described herein provide a convertible package assembly and display system that offers significant cost and corrugate savings when compared to the prior art. In traditional RSC (regular slotted case) designs, the cases must be pre-glued at the overlapping seam. This additional machine step increases material cost and complicates the storage of semi-completed blanks. In addition, redundant, overlapping material is required on the two sides with closures. As disclosed herein, assembly embodiments utilize a case design, commonly referred to as an FSC (flange seal case). This design eliminates the waste and additional machine step, typically saving 20-30% in material cost.

In another aspect of the present disclosure, the assembly blank (from which the case of the assembly is formed from) provides a form that is easily machinable. In many prior art examples, the design of a retail-ready case commonly complicates the process of forming. Elaborate tear strips, score lines, and additional features dilute the ability of the machinery to form the case. Again, in embodiments disclosed herein, the assembly design is based on a conventional FSC (flange seal case). Scoring is limited to the bottom portion of the case, allowing machines to form the case efficiently and with precision. In some embodiments a key feature is the use of asymmetrical top flaps. The offset flaps do not impede the final forming (closing) operation, but significantly impact the retail configuration of the assembly case.

In yet another aspect of the disclosure, the assembly case design provides a form that is more aesthetically pleasing. Scoring on the bottom portion of the case allows for aggressive cut patterns and easy tear-away. In addition, the design allows for a machine-cut front edge and partial side edges for excellent shelf-appeal. This is opposed to many prior art assemblies which are manufactured to include perforated, tear-away strips or lines.

BRIEF DESCRIPTION OF THE DRAWINGS

A detailed description of the present disclosure is hereafter described with specific reference being made to the drawings.

DETAILED DESCRIPTION OF THE DRAWINGS

Figure 1:
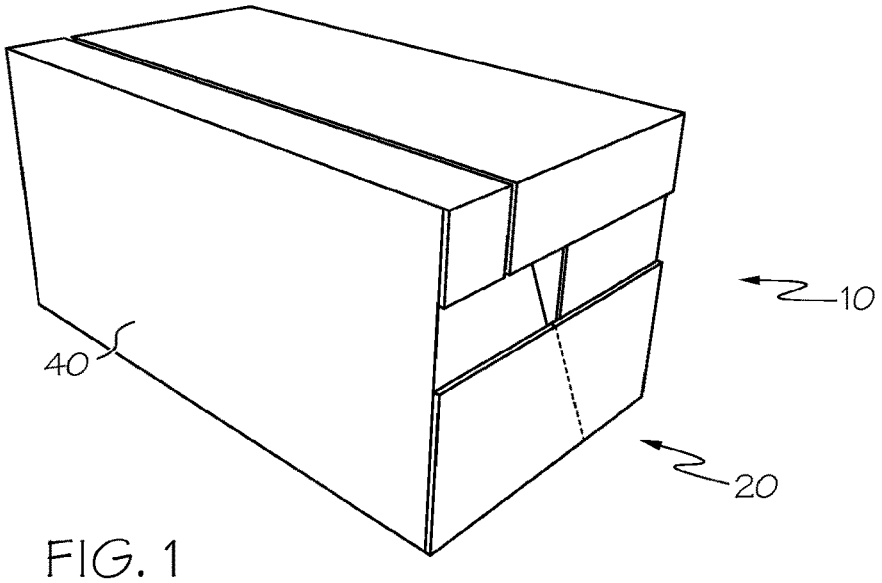
FIG. 1 is a side perspective view of an embodiment of the package assembly in the shipping configuration.

While a package assembly of the present disclosure may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

As is shown in FIG. 1 in at least one embodiment a package assembly 10 comprises a case 20. When in the package or shipping configuration shown in FIG. 1 the case 20 is defined by a blank 30 that has been folded from a single piece of packaging material 40 into the case 20 to contain a plurality of product containers 50, such as are shown in FIG. 2.

Figure 2:
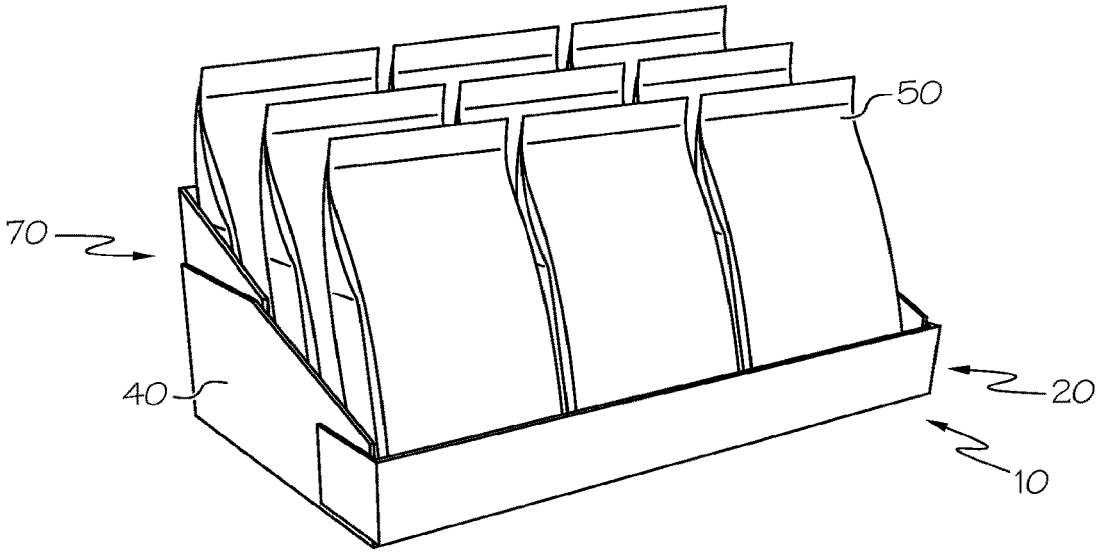
FIG. 2 is a front perspective view of the package assembly shown in the display configuration.
Figure 15:
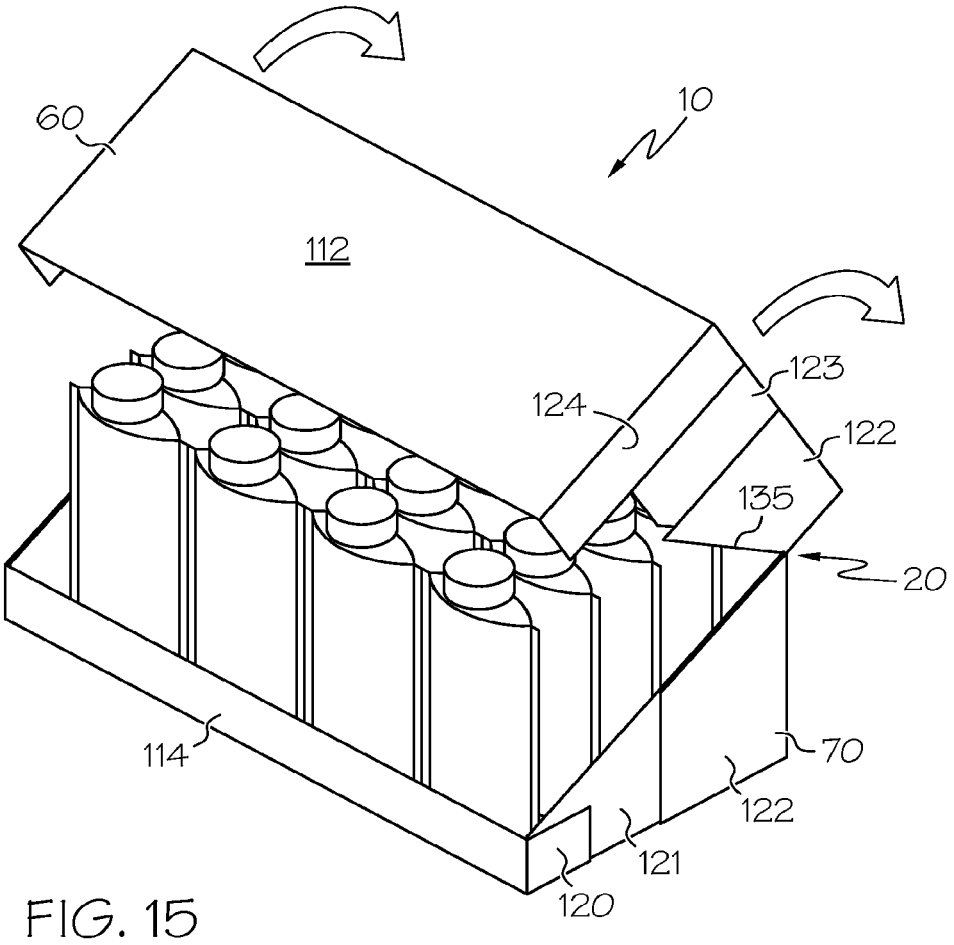
FIGS. 15-16 are a front perspective view illustrating the removal of the top component of the case from the bottom component in the manner illustrated in FIG. 13 to place the assembly in the display configuration.

In FIG. 2, it is illustrated that when the package assembly 10 is converted to the display configuration shown, a top portion of the case 20 is removed (the removed top portion 60 is shown in FIG. 15) to allow the product containers 50 to be displayed on the remaining self-ready bottom portion 70. The mechanism for removal of the top portion from the bottom portion 70 of the case 20 is discussed in greater detail below.

Turning now to FIGS. 3-7, the initial construction of the case 20 from the single blank 30 is shown. Blank 30 can be constructed of any suitable or desired packaging material as necessitated by the size, shape and weight of the product containers 50 to be contained within the case 20.

Figure 3:
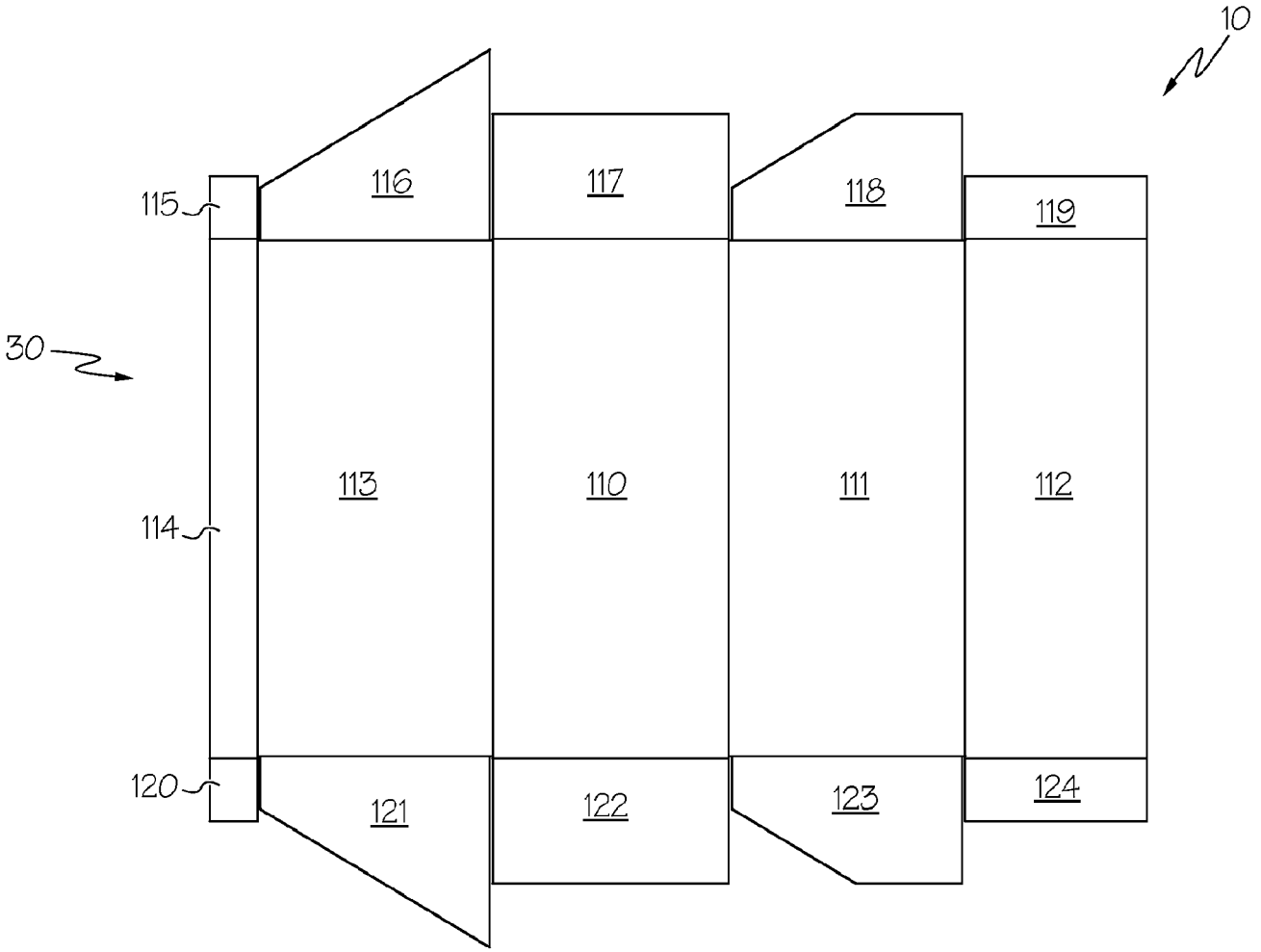
FIG. 3 is a top down view of the blank from which the package assembly case is formed.
Figure 5:
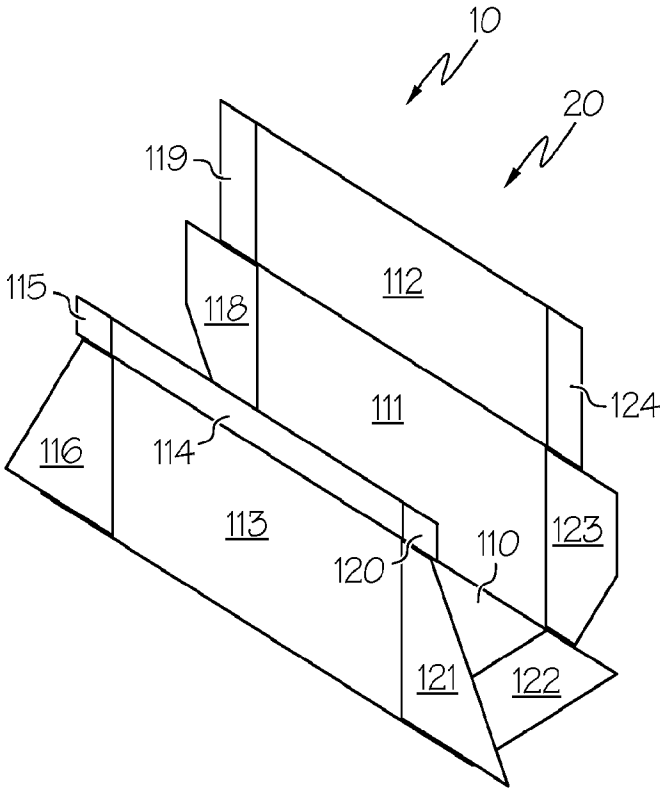
FIGS. 4-7 illustrate a sequence of steps for forming the case from the blank shown in FIG. 3.
Figure 4:
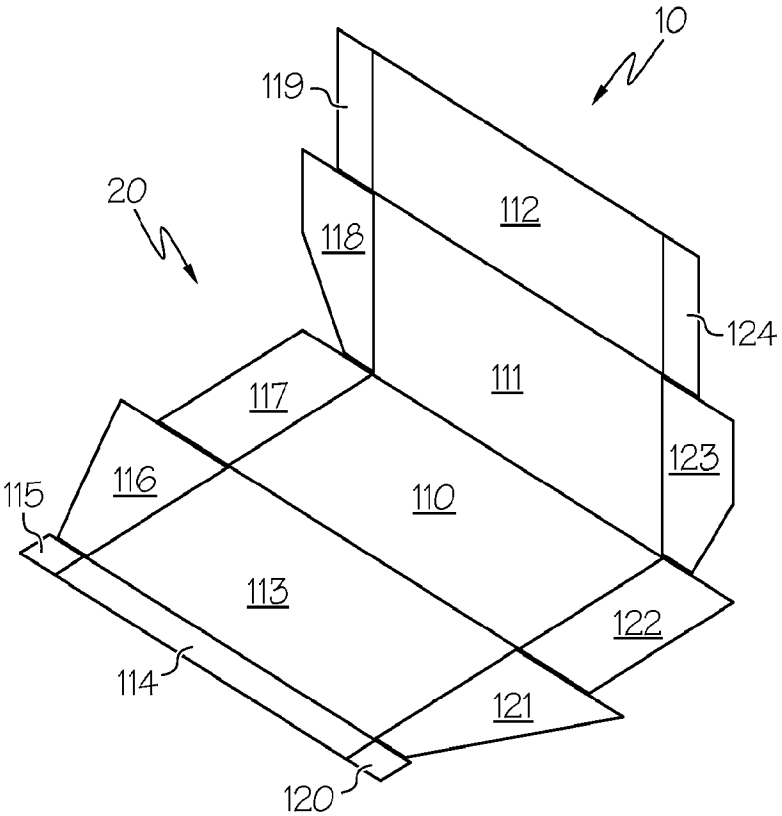
Figure 7:
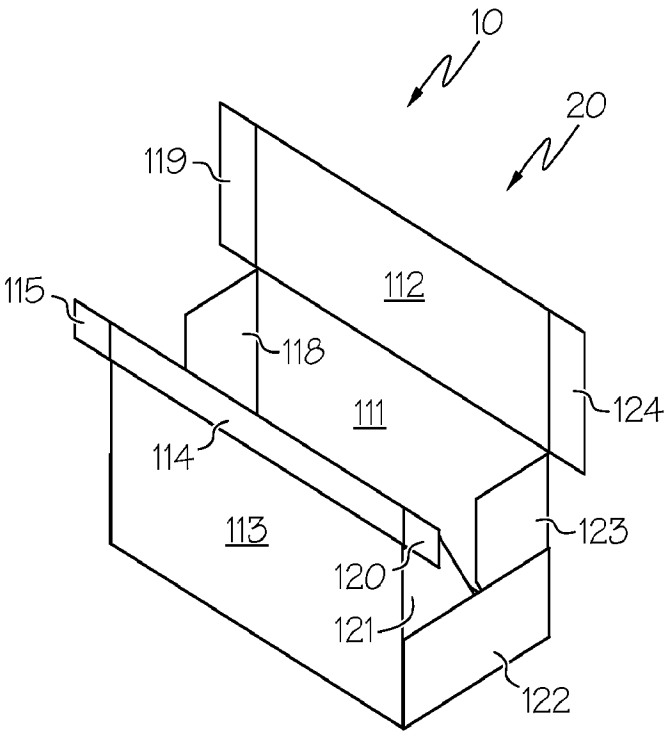
Figure 6:
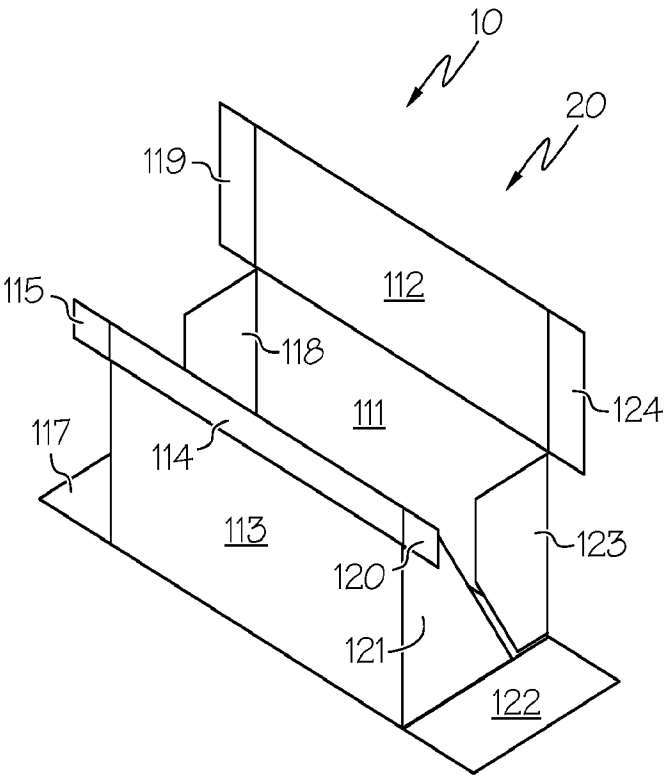
Figure 23:
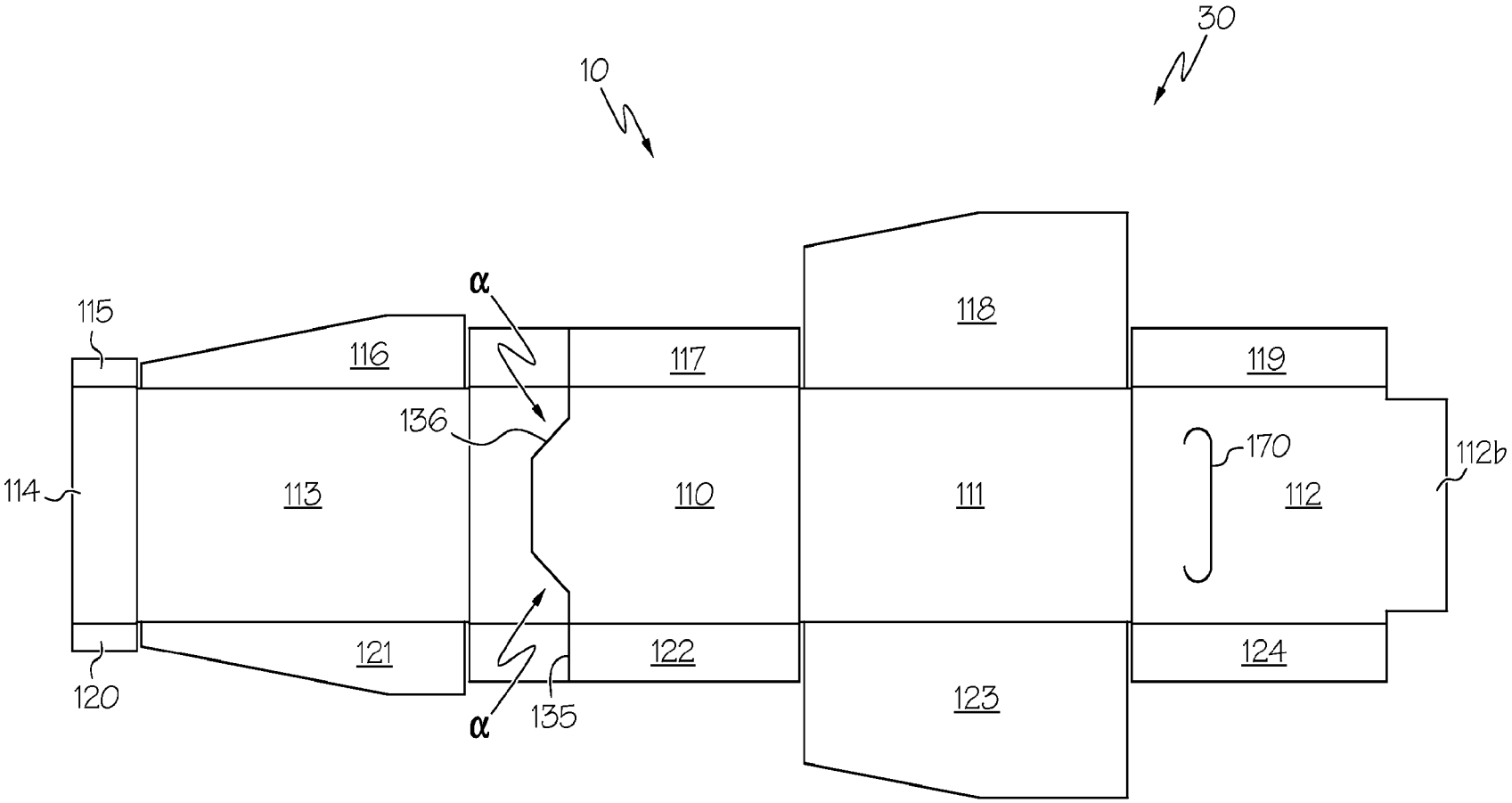
FIG. 23 is top down view of the blank form from which the package assembly of FIG. 21 is formed.

For example, in at least one embodiment the blank 30 is constructed from cardboard (corrugated or otherwise) cut and seamed according to the pattern shown in FIGS. 3 and 23. Other materials that blank 30 can be constructed from include: press-board, chipboard, SBS board, wood, one or more paper product derivatives, plastic, metal, or other materials. Preferably, the blank is constructed from a light weight material that may be easily and inexpensively recycled or disposed of.

As is shown in FIGS. 3 and 23, blank 30 comprises several distinct sections or regions 110-124 as defined by preformed seems or fold-lines (larger section being considered panels, smaller sections being flaps or tabs).

The blank 30 shown in FIG. 3 has fifteen (15) sections 110-124 having a polygonal shape, with thirteen sections 110-117, 119-122, and 124 having a four sides, a quadrilateral shape (quadrilateral sections), and two sections 118, 123 having five sides, a pentagonal shape (pentagonal sections). As shown in FIG. 3, sections 111 and 113 have the same quadrilateral shape and size; sections 115 and 120 have the same quadrilateral shape and size; sections 116, and 121 have the same quadrilateral shape and size; sections 117 and 122 have the same quadrilateral shape and size; sections 118 and 123 have the same pentagonal shape and size and sections 119 and 124 have the same quadrilateral shape and size. Sections 115-117 have different quadrilateral shapes and different sizes while sections 117 and 119 have the same quadrilateral shape but different sizes.

The blank 30 has two ends positioned opposite one another, each end having linear edges and two sides positioned opposite one another, each extending between the two ends and having non-linear edges. Sections 114, 115, and 120 aligned to form one end with a linear edge; sections 112, 119, and 124 aligned to form another end with a linear edge; sections 115-119 aligned to form one side with a non-linear edge; and sections 120-124 aligned to form the other side with a non-linear edge. As can be seen in FIG. 3, sections 115, 119, 120, and 124 each form a part of one end and one side. Sections 110-111 and 113 are aligned to form the interior of the blank 30. Sections 115-119 and 120-124 have one or two sides that are separated from an adjacent section to that the sections 115-119 and 120-124 can be folded to form the sides of the case 20 in the shipping configuration, as discussed below. Also discussed below in greater detail, the blank 30 includes tear lines 135 and 136 that extend only through sections 110, 117, and 112, and sections 111-116, 118-121, and 123-124 have no tear lines (not shown). As can be seen for example in FIGS. 14-17, the tear lines 135, 136 form a single continuous tear line. Thus the first and second tear lines 135, 136 can be considered to form sections of the single continuous tear line. A "tear line" as used herein is a mechanism for the removal of a portion of the package assembly.

The outer edge of sections 112 and 114 are straight. However, as discussed below, if the sections 112 and 114 are modified to include value added features, the outer edge of sections 112 and/or 114 may not be straight. Thus three or four sides of the blank 30 can have irregular edges.

Figure 19:
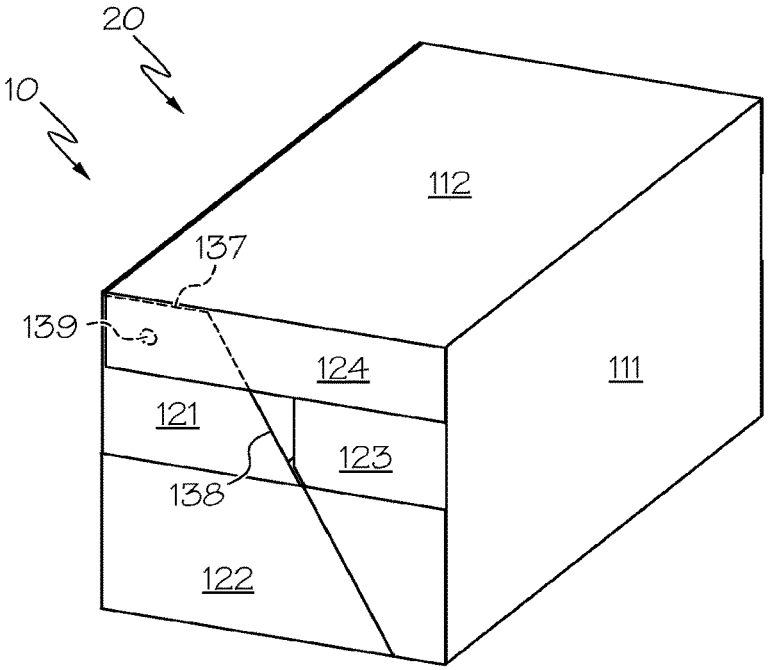
FIG. 19 is a perspective view of the package assembly shown in FIGS. 3-17 with a modification.

The blank 30 shown in FIG. 3 can be modified by eliminating sections 114, 115, and 120; extending section 112 so that section 112 can form the entire top surface of the case 20; and extending sections 119 and 124 the same extent as section 112 (see case shown in FIG. 19. Thus, this blank 30 has twelve (12) sections, with ten (10) sections 110-113, 116-117, 119, 121-122, 124 having a quadrilateral shape, and two sections 118, 123 having a pentagonal shape (reference FIG. 3). Sections 111 and 113 have the same quadrilateral shape and size; sections 110 and 112 have the same quadrilateral shape and size; sections 116, and 121 have the same quadrilateral shape and size; sections 117 and 122 have the same quadrilateral shape and size; sections 118 and 123 have the same pentagonal shape and size; and sections 119 and 124 have the same quadrilateral shape and size. Sections 116 and 117 have different quadrilateral shapes and sizes, while sections 117 and 119 have the same quadrilateral shape but different sizes. This blank 30 also has two ends with linear edges positioned opposite one another, and two sides with non-linear edges positioned opposite one another and each extending between the two ends, with sections 113, 116, and 121 aligned to form one end with a linear edge; sections 112, 119, and 124 aligned to form another end with a linear edge; sections 116-119 aligned to form one side with a non-linear edge; and sections 121-124 aligned to form the other side with a non-linear edge. Sections 110 and 111 are aligned to form the interior of the blank 30. Sections 116, 119, 121, and 124 each form a part of one end and one side. As discussed below, the blank 30 includes tear lines 135 and 136 that extend only through sections 110, 117, and 112 (not shown). As can be seen for example in FIG. 20, the tear lines 135, 136 form a single continuous tear line. Thus the first and second tear lines 135, 136 can be considered to form sections of the single continuous tear line. Sections 111-116, 118-121, and 123-124 have no tear lines.

The pattern shown in FIG. 23 has fifteen (15) sections 110-124 having a polygonal shape, with ten sections 110-111, 113-115, 117, 119-120, 122, and 124 having a quadrilateral shape, four sections 116, 118, 121, 123 having a pentagonal shape, and one section 112 having eight sides, an octagonal shape. As can be seen in FIG. 23, sections 111 and 113 have the same quadrilateral shape and size; sections 115 and 120 have the same quadrilateral shape and size; sections 116 and 121 have the same pentagonal shape and size; sections 117 and 122 have the same quadrilateral shape and size; sections 118 and 123 have the same pentagonal shape and size; and sections 119 and 124 have the same quadrilateral shape and size. In contrast to section 112 of the pattern shown in FIG. 3, section 112 of the pattern shown in FIG. 23 includes a projecting tab 112*b*. The blank 30 has one end with a linear edge positioned opposite an end with a non-linear edge, and two sides with non-linear edges positioned opposite one another and extending between the two ends, with sections 114, 115, and 120 aligned to form the end with a linear edge; sections 112, 119, and 124 aligned to the end with a non-linear edge; sections 115-119 aligned to form one side with a non-linear edge; and sections 120-124 aligned to form the other side with a non-linear edge. As can be seen in FIG. 23, sections 115, 119, 120, and 124 each form a part of one end and one side of the blank. Sections 110, 111, and 113 are aligned to form the interior of the blank 30. Sections 115-119 and 120-124 have one or two sides that are separated from an adjacent section to that the sections 115-119 and 120-124 can be folded to form the sides of the case 20 in the shipping configuration, as discussed below. The blank 30 includes tear lines 135 and 136 that extend only through sections 110, 117, and 122. As can be seen in FIG. 23, the tear lines 135, 136 form a single continuous tear line. Thus the first and second tear lines 135, 136 can be considered to form sections of the single continuous tear line. Sections 111-116, 118-121, and 123-124 have no tear lines. The blank 30 also includes a through-score line 170 for a handle opening. Since no portion of the package assembly is removed when the through-score line 170 is torn, the through-score line 170 is not a tear line as used herein. As shown in FIG. 23, the through-score line 170 is positioned entirely in section 112.

In at least one aspect, tailoring the size of the vertical supporting sections 116, 118, 121, and 123 provides the case 20 with a strength equivalent to a regular slotted case (RSC). In a shipping configuration, these sections 116, 118, 121, and 123 form 90 degree column-like supports with the corrugated flutes in the direction of the palletized load.

Figure 11:
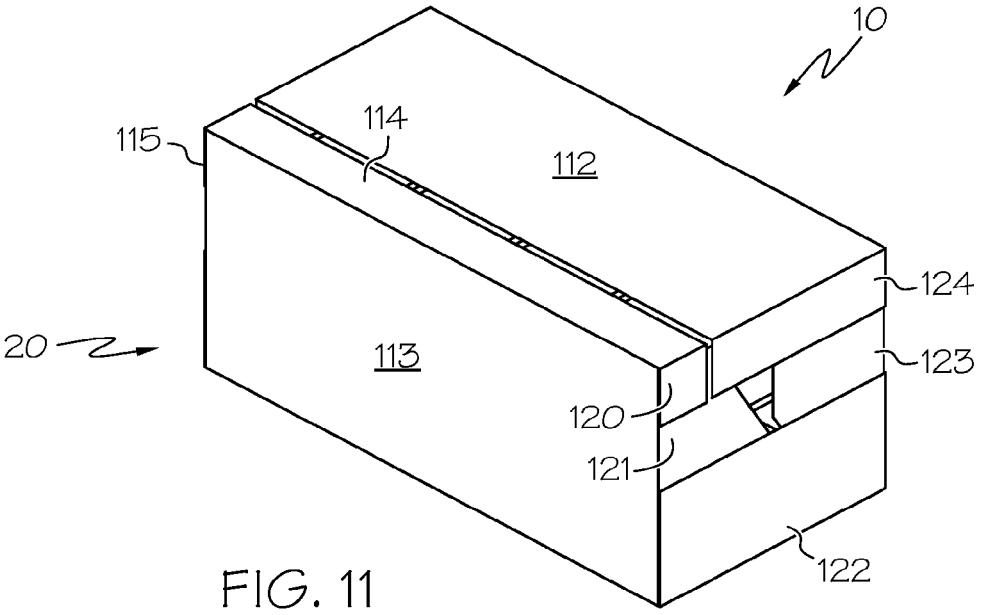
Figure 12:
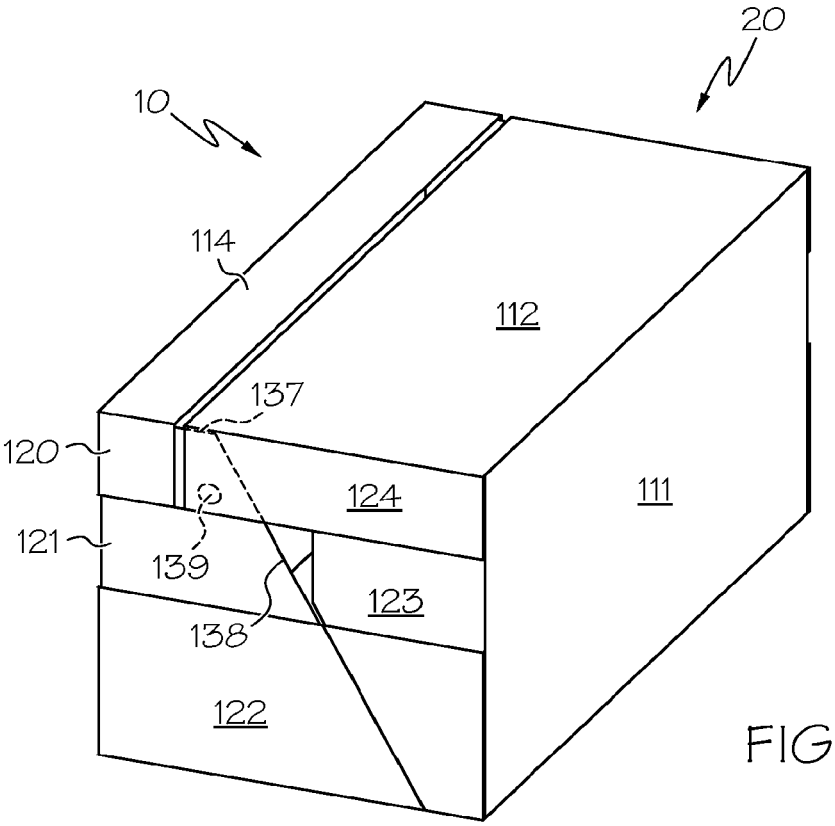
FIG. 12 depicts a modification of the package assembly and further securement of the package assembly with a small amount of adhesive.

In at least one embodiment the various sections are folded into the desired shape of the case 20, in the manner shown in FIGS. 4-7. Sections 115-119 and 120-124 form sides of the case 20 in the shipping configuration and sections 110-114 form the top, bottom, front, and back of the case 20 in the shipping configuration, as can be seen in FIGS. 11-12, 19, and 22. As shown in FIGS. 11-12, section 114 functions as part of the closure of the case 20 when the package assembly 10 is in the shipping configuration. As can be seen for example in FIGS. 11-12, 18-19, and 22, the sections forming each side of the case 20 in the shipping configuration define a gap.

For the blank 30 shown in FIG. 23, when the blank 30 is folded, the projecting tab 112*b* of section 112 slips underneath section 114 with the sides of the tab 112*b* butting with and keying into the folded minor tabs formed by sections 115 and 120, (see e.g. FIG. 23). This arrangement strengthens and stabilizes the shipping configuration of the package assembly yet does not inhibit the transition to the display configuration.

Figure 8:
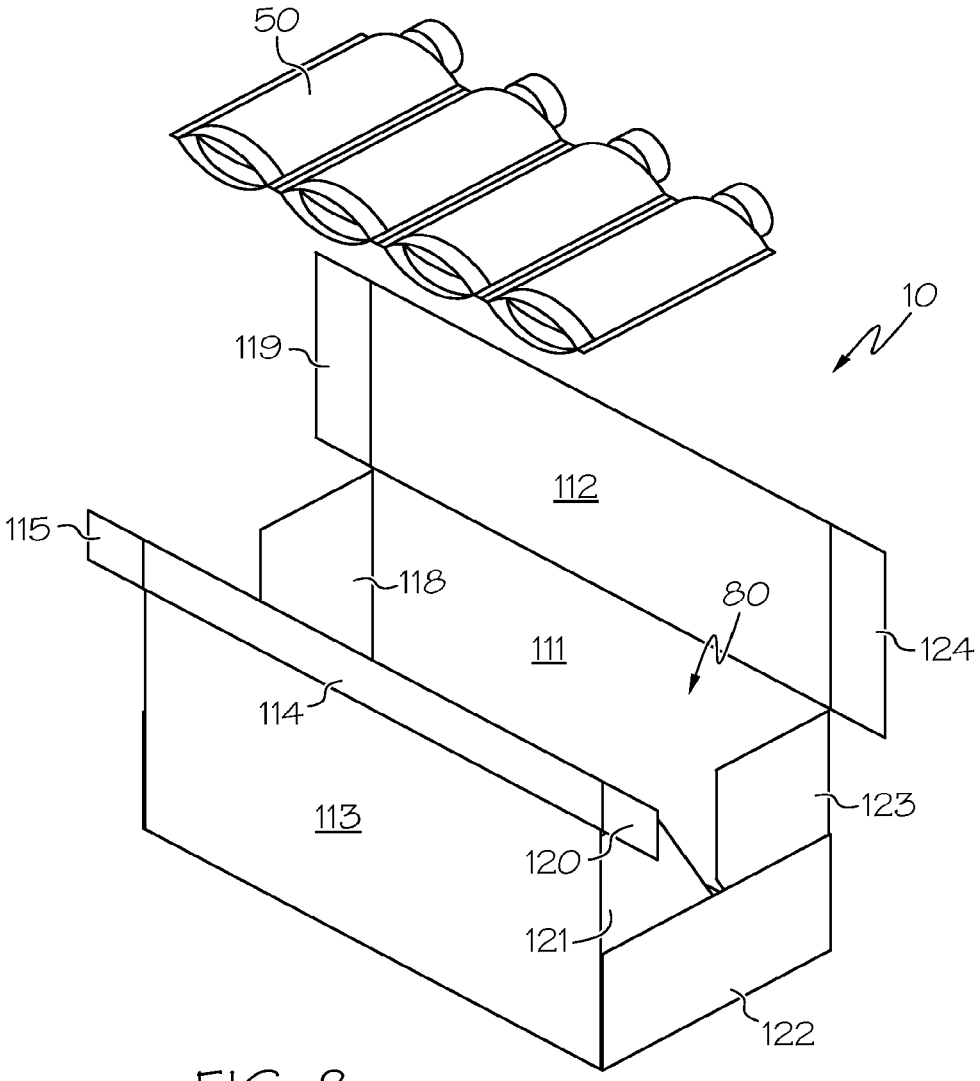
FIGS. 8-9 depict the case of FIG. 7 being loaded with product containers prior to final formation of the package assembly (shipping configuration).
Figure 9:
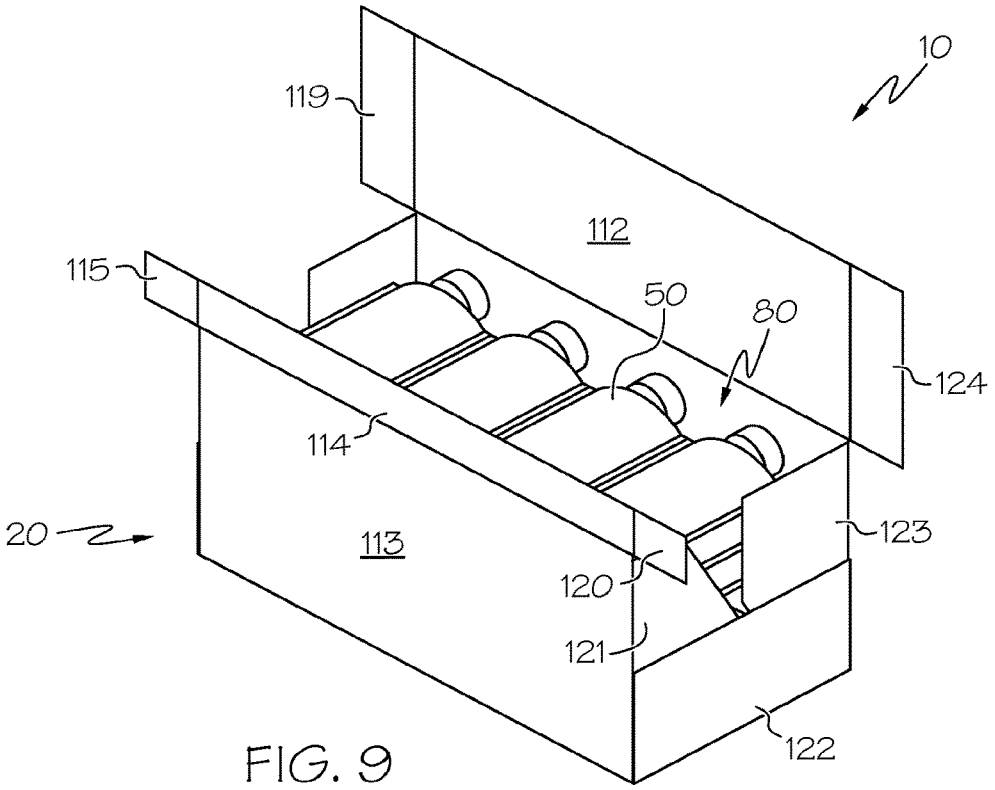
Figure 10:
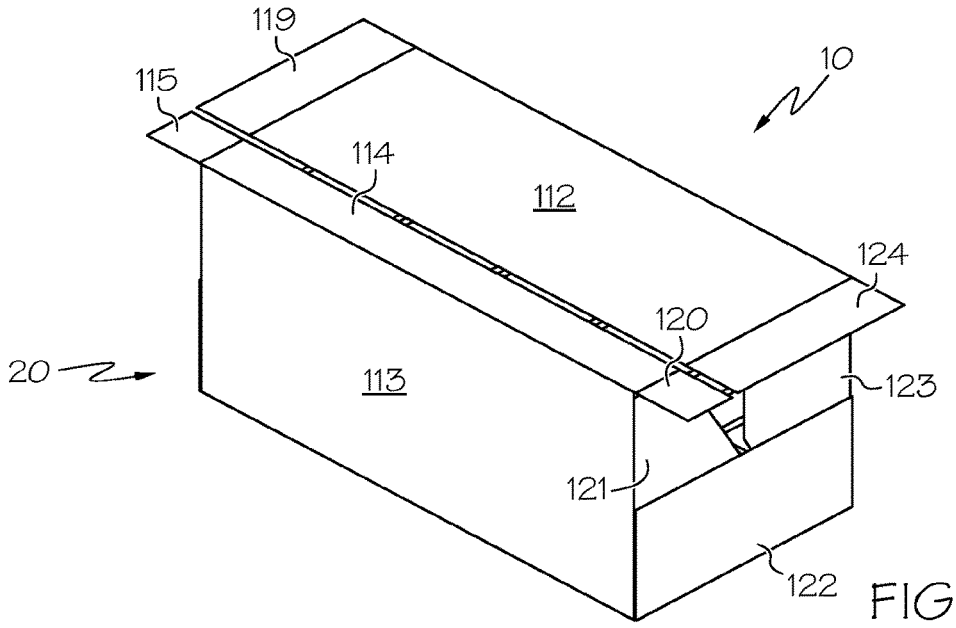
FIGS. 10-11 depict the securement of the unsecured top flaps to form the completed shipping configuration of the package assembly.

At some point before the case 20 is fully formed and all the sections are secured together, product containers 50 are loaded into the open top 80 of the case 20 in the manner shown in FIGS. 8-9. Once the case 20 is fully loaded, the remaining sections 112, and 114 are secured, along with flap sections 119, 124 and 115 and 120 in the manner shown in FIGS. 10-11 to complete the formation of the case 20 as well as the package or shipping configuration of the package assembly 10. For the case shown in FIG. 22, product containers are loaded before section 112 is folded over and the projecting tab 112*b* is slipped underneath section 114.

It can be appreciated that adjustments to supporting sections 116, 118, 121, 123, can strengthen the structural stability and stiffness of the package assembly 10 in the shipping configuration. An example of which is shown in FIGS. 12 and 19, where the leading edge 138 of section 121 is extended towards section 123, as compared to section 121 of the blank 30 shown in FIG. 3. The result is an extension of facing edge 137 of section 121 towards section 113. The leading edge of section 116 can also be similarly extended. Thus flap 112, in conjunction with minor flaps 124 and 119 abut with and encapsulate surfaces and edges of sections 121 and 116.

In addition, as shown in FIGS. 12 and 19, a small dot of glue deposited at location 139, can be added to link sections 124 and 121 together for further stability of the package assembly 10 in the shipping configuration. It is noted that this small amount of adhesive does not materially inhibit the opening process.

Figure 21:
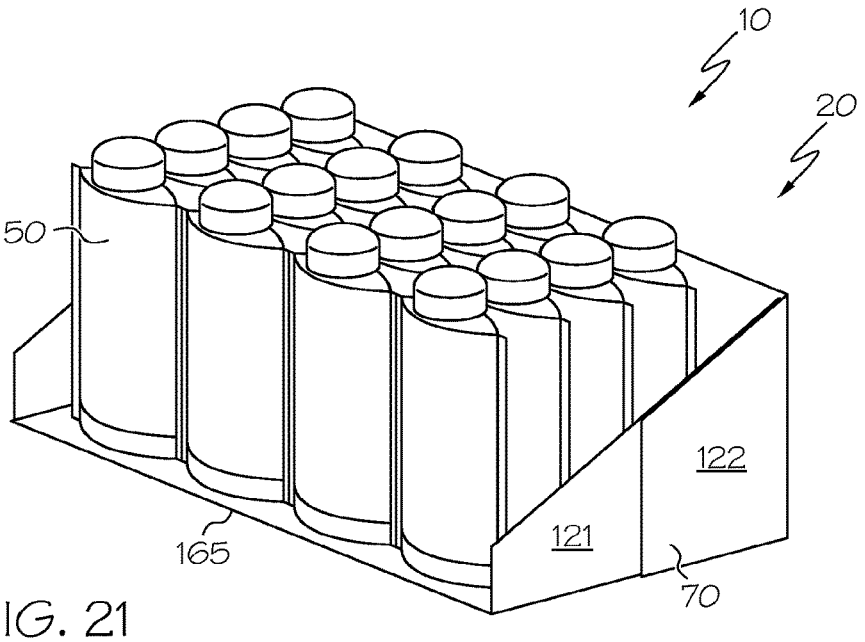
FIG. 21 is a perspective view of the package assembly of FIG. 19 in the display configuration.

As noted above, the case 20 includes a mechanism for removal of the top portion 60 from the bottom portion 70. Equally as important as preserving the contents of the package assembly 10, the case 20 must be easily convertible upon shelf placement in the retail store. Retailers specify that a package should contribute to a more efficient shelf replenishment process, with packaging able to be opened easily in one or two steps without the aid of tools. A package assembly 10 of the present disclosure simultaneously offers superior aesthetics while simplifying the conversion from the shipping configuration to the display configuration. Further, as discussed below, the display configuration can include a front facing portion (e.g. FIG. 17), or have no front facing portion (e.g. FIG. 21). A package assembly 10 that does not have a front facing portion in the display configuration provides for full exposure of the graphics of the product containers and/or allows customers to easily access all the product containers in the package assembly. It is noted that sometimes removal of a tall container over a front facing portion can be difficult depending on the available clearance. A package assembly 10 that does not have a front facing portion in the display configuration, reduces the possibility that the retailer would have to adjust the height of the shelving for the customer to access and remove a tall product container.

The transition of the package assembly 10 from the shipping configuration shown in FIG. 1 to a display configuration shown in FIG. 2 relies on the presence and of tear lines 135 and 136, whose function is illustrated in FIGS. 13-16. FIG. 17 shows the bottom portion 70 without product containers to show the edges 140-145 of the bottom portion 70 after the top portion has been removed along the tear lines 135 and 136.

As shown in FIG. 15, the case 20 formed by the pattern shown in FIG. 3 has an angled first tear line 135 that extends across the flaps 122 and 117; and a second tear line 136 that extends across bottom section 110. Thus, the tear lines 135, 136 divide three sections 110, 117, 122 into six partial sections. As can be seen for example in FIG. 14, the tear lines 135, 136 are straight and form a single continuous tear line. Thus the first and second tear lines 135, 136 can be considered to form sections of the single continuous tear line. The tear lines 135, 136 of the case 20 shown in FIG. 19 are the same as the tear lines of the case shown in FIG. 15.

Figure 14:
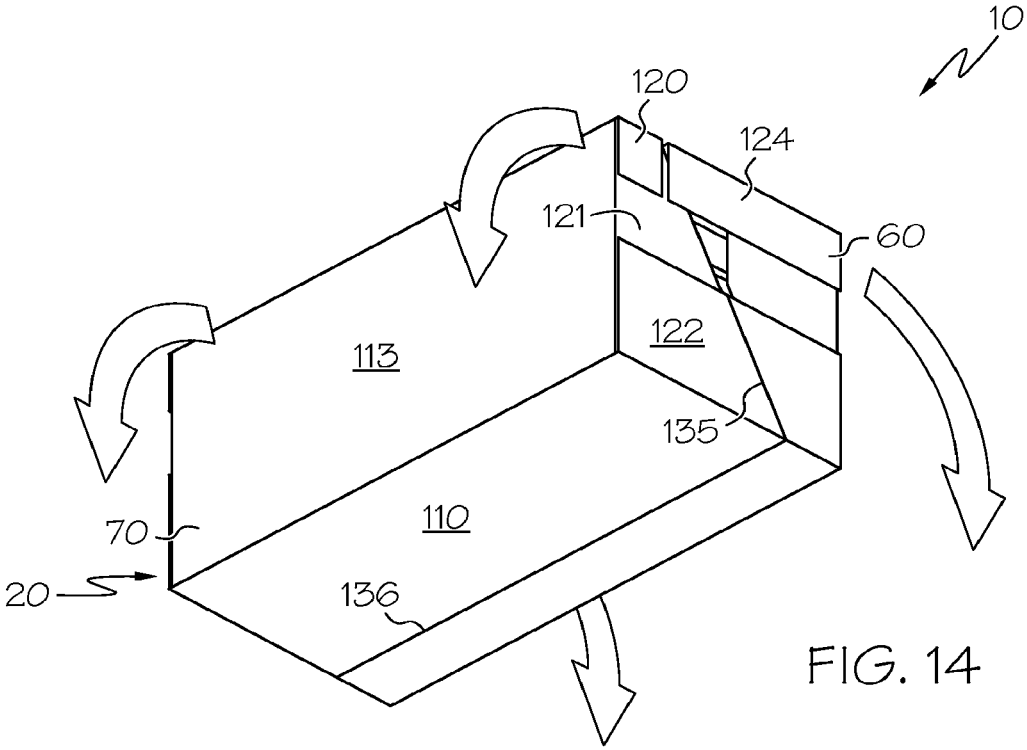
FIG. 14 is a rear bottom view of the assembly shown in FIG. 14 wherein the scoring line separating the top component and the bottom component is shown.
Figure 16:
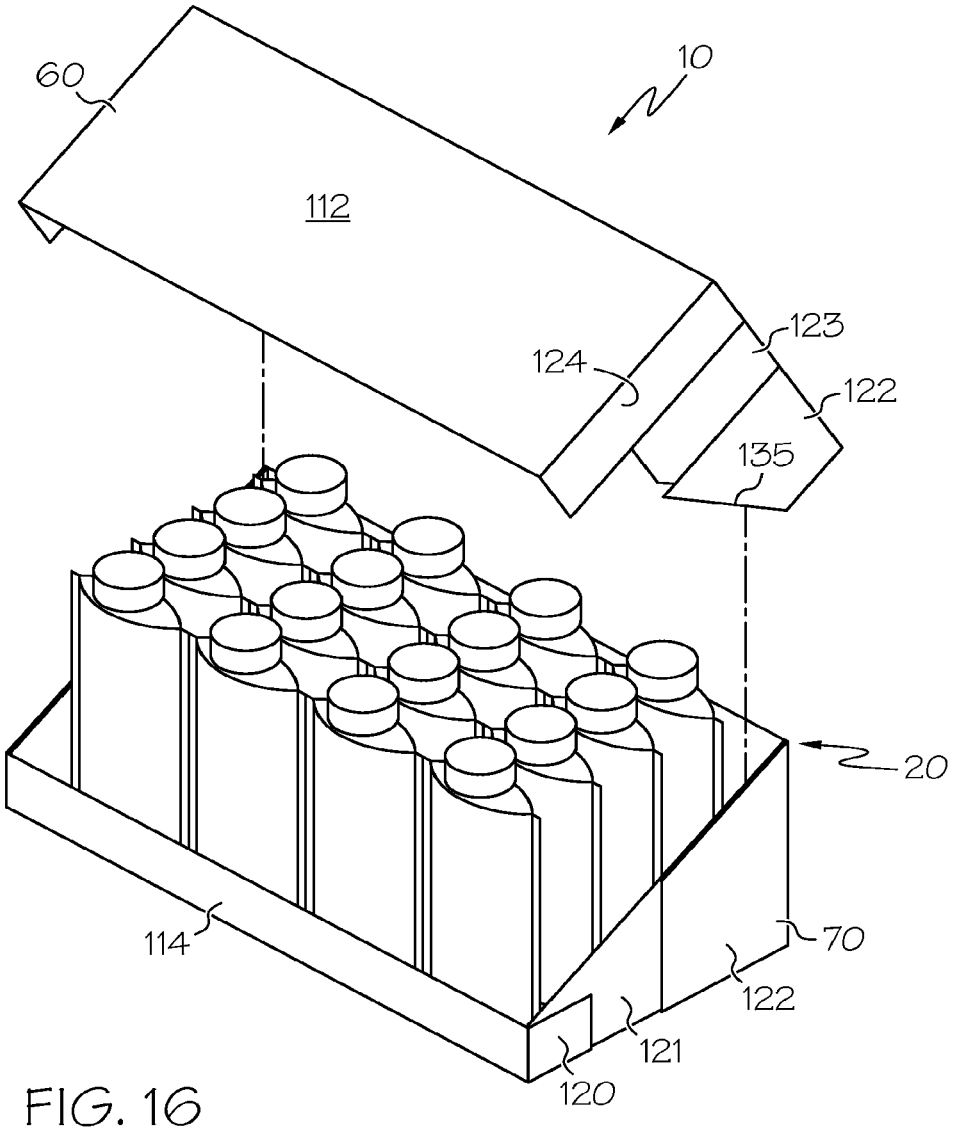
Figure 17:
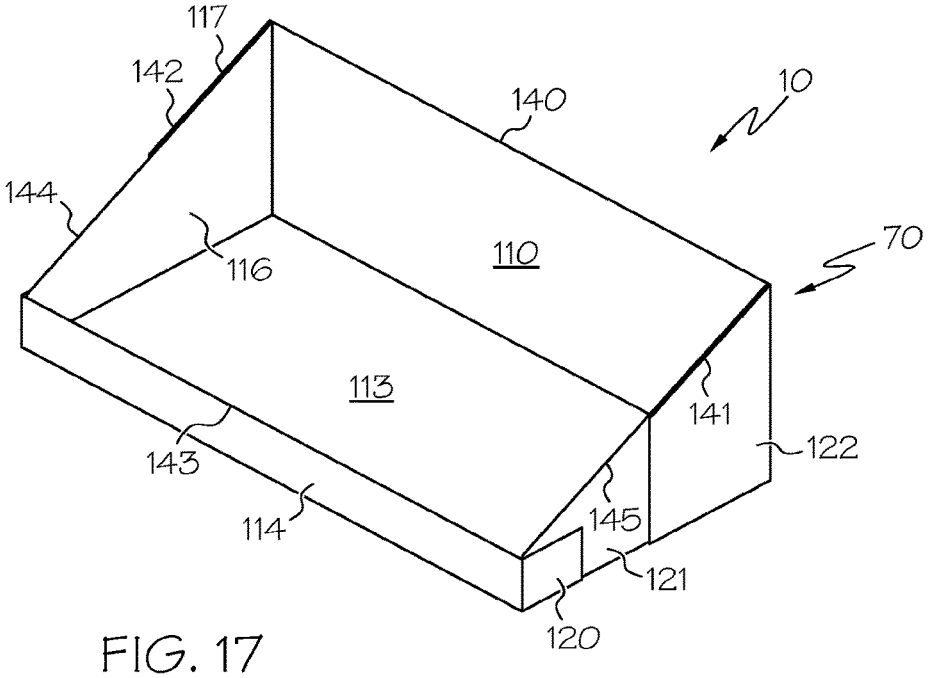
FIG. 17 shows the bottom portion of the display configuration.

The first and second tear lines 135, 136 are positioned so that a top portion 60 of the case 20 is completely removable from the bottom portion 70 such as in the manner shown in FIG. 15-16. As can be seen the top portion 60 is formed by sections 111-112, 118-119, 123-124, and partially by sections 110, 117, and 123 which are divided by the tear lines 135, 136. By rotating the case 20 ninety degrees (90°) when replenishing the shelf, the machine cut ledge, section 114, becomes the front facing portion of the case 20, as shown in FIGS. 14-16.

Figure 13:
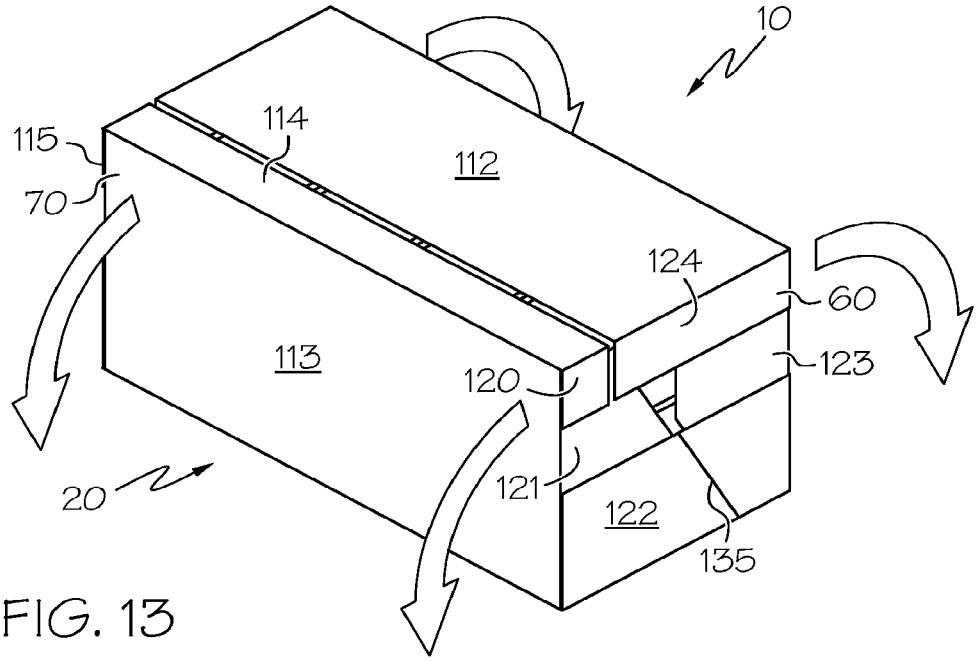
FIG. 13 is a perspective view of the package assembly wherein arrows illustrate the direction in which top and bottom components are separated to place the assembly in the display configuration.

A case 20 as shown in FIGS. 12-13 can be described as comprising a bottom; a top; first and second sides opposite one another; third and fourth sides opposite one another, each being partially opening and comprising a top flap and a bottom flap separated from the top flap, the top flap attached to the top of the box; an angled first tear line extending across the bottom flap; and a second tear line extending across the bottom, where the first and second tear lines are positioned so that the bottom, one of the first and second sides, and the bottom flaps are removable by separating them along the first and second tear lines.

Figure 22:
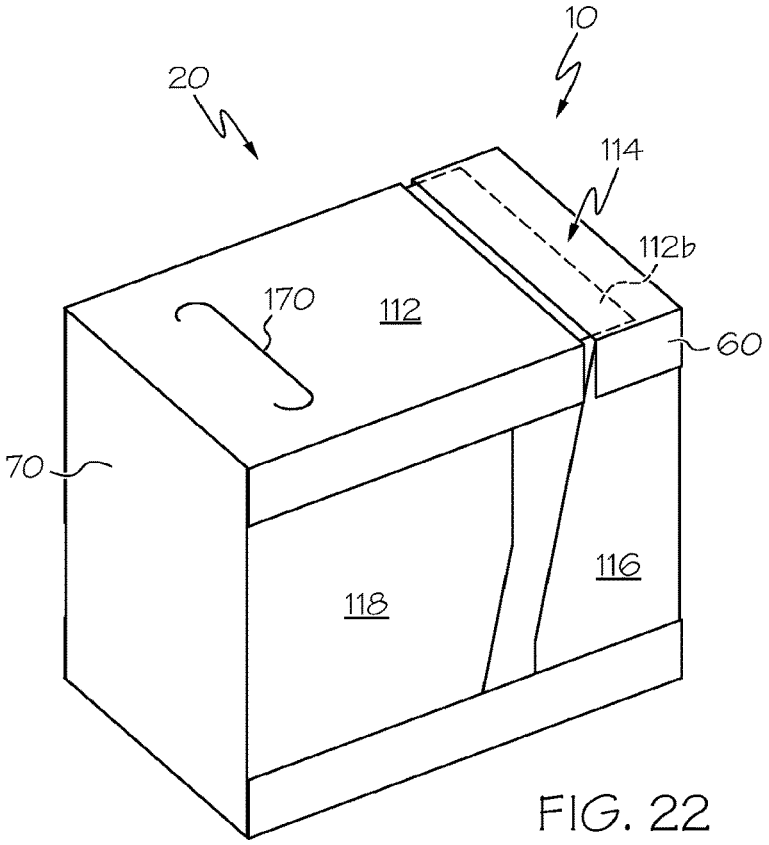
FIG. 22 a perspective view of an embodiment of the package assembly in the shipping configuration.

The case 20 shown in FIG. 22 has two tear lines 135, 136 that extend across sections 110, 117, and 112 to form a single continuous tear line, as shown in FIG. 23. In this embodiment, the tear lines 135, 136 have compound angles $\alpha$. In at least one embodiment, the compound angle $\alpha$ is about 25 to 35 degrees. In one aspect, tear lines configured in compound angles provide a balance between ease of opening versus shipping integrity. In another aspect, tear lines configured in compound angles decrease the likelihood of complications in the formation of the case.

The case 20 shown in FIG. 22 also includes a single handle opening to facilitate the transition of the package assembly 10 from the shipping configuration to the display configuration. In some embodiments, a through-score line 170 forms the handle opening. For the package assembly 10 shown in FIG. 22 to transition from the shipping configuration to a display configuration, the handle opening is grasped as sections 111-112, 118-119, and 123-124, and the parts of sections 110, 117, and 122 extending from sections 111, 118, and 123 to the tear lines 135, 136, are removed from the package assembly 10.

The tear lines can be provided by any desired mechanism, such as for example: by providing a continuous line of perforations, a tear strip, a pre-cut incision that does not extend entirely through the material of the blank 30, etc.

Figure 20:
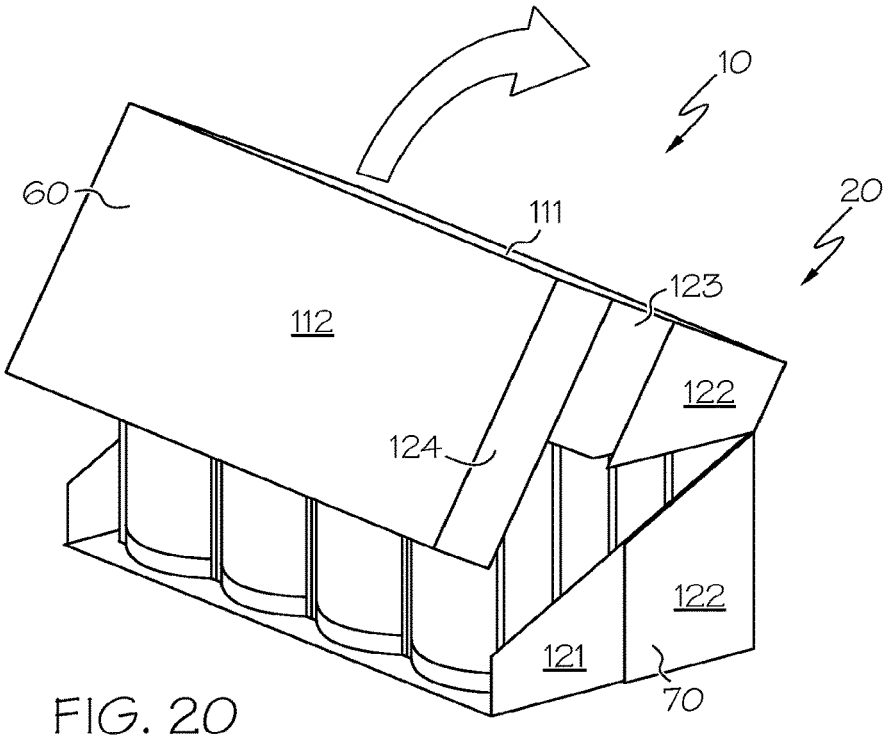
FIG. 20 is a perspective view of the package assembly of FIG. 19 wherein the arrow illustrate the direction in which the top and bottom components are separated to place the assembly in the display configuration

As can be seen by the embodiments of the present disclosure, less than 50% of the angular, cross-sectional plane of the shipping configuration requires perforations for conversion to the display configuration. In contrast, in several examples of prior art package assemblies, nearly 100% of the angular, cross-sectional plane in the package assembly in the shipping configuration requires perforations. By eliminating the tearing of the case by a significant margin, a simpler, and error free process is evident by the package assembly of the present disclosure. Yet another feature of the package assembly 10 of the present disclosure that contributes to simple shelf replenishment is the large amount of leverage created for the removal of the discarded section, top portion 60, of the case 20. In addition to reducing the propensity for ragged tears, the reduction in perforations creates an ideal, second-class lever to break the scored area of the case 20. The leverage created by the design disclosed herein greatly simplifies the process of opening the case. As discussed above, tear lines 135 and 136 are scored, or perforated, lines in the case 20. The case 20 is separated orthogonally to the gap between sections 112 and 114, as shown in FIGS. 15 and 20. Thus, the tear line 136 becomes the hinge or fulcrum of the case 20. Leverage is created by the distance from the gap to the fulcrum, to the first point of resistance, at the start closest to the gap of tear line 135.

Furthermore, as mentioned above when referring to the pleasing shelf aesthetics of the case, scoring on the bottom portion of the case 20 allows for an aggressive perforation pattern since this region of the case 20 has little impact on the column of the case in the shipping configuration. Thus, the pattern can allow for easy separation, while not adversely affecting the strength.

Figure 18:
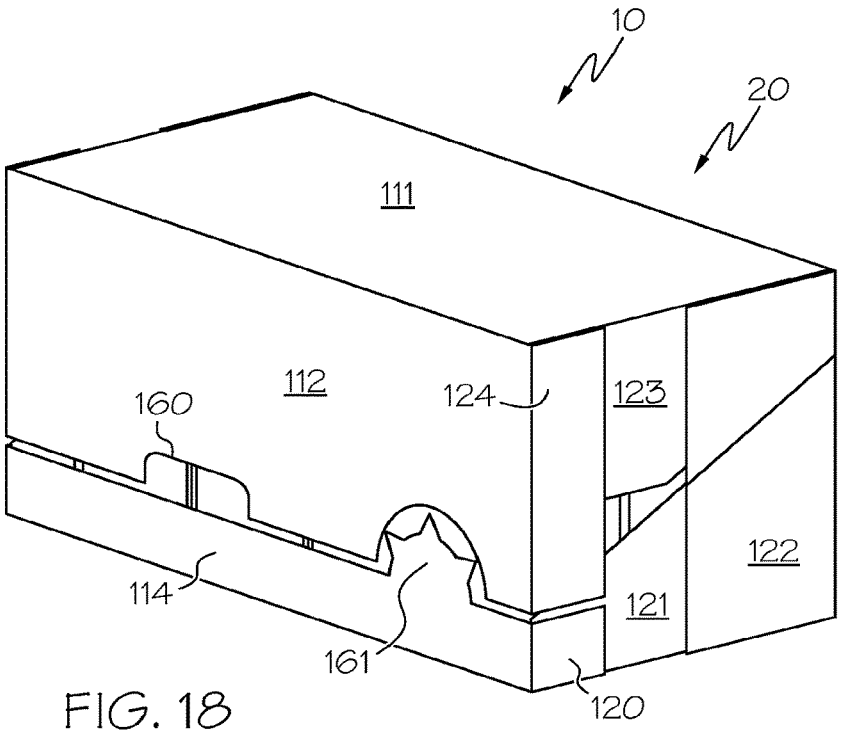
FIG. 18 shows modification of the package assembly to include value added features.

Moreover, since sections 112 and 114 are machine cut, the package assembly 10 can include one or more value added features. For example, as shown in FIG. 18, the package assembly 10 can include rectangular cutouts 160 for hand access; partial or complete elements for printed logos 161; circular holes for cooling, and combinations thereof. As can be seen in FIG. 18, when the package assembly 10 is modified to include a value added feature, one or both sections 112, 114 can have edges that are non-linear.

In the various embodiments depicted herein, the package assembly may be of any size or shape in keeping with the convertible shipping to display configurations shown and described herein. The assembly can be configured to contain and display any size, shape or number of product containers. Further, the assembly can be adjusted to the distribution requirements of a retailer, for example by adjusting the width and shape of sections 117, 118, 121, and 123 of the case 20.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

The invention claimed is:

1. A package assembly comprising: a case formed from a single piece of packaging material with a single tear line, the case having a shipping configuration and a display configuration;

the case in the shipping configuration having a top portion and a bottom portion enclosing a space for product containers, the single piece of packaging material comprising fifteen polygonal sections folded to form the case, three of the fifteen polygonal sections divided by the tear line into six partial sections, the top portion of the case comprising six full sections and three of the six partial sections, and the bottom portion of the case comprising six full sections and the other three of the six partial sections;

the case in the display configuration having a bottom portion for displaying product containers and a front panel portion, one of the six full sections forms the front panel portion of the case in the display configuration, wherein the case is convertible from the shipping configuration to the display configuration by separating the top portion from the bottom portion along the single tear line.

2. The package assembly of claim 1, further comprising a through-score line for a handle opening, the handle opening defined by one of the six full sections of the top portion of the case.

3. The package assembly of claim 1, the fifteen polygonal sections comprising thirteen quadrilateral sections and two pentagonal sections.

4. The package assembly of claim 3, the fifteen polygonal sections comprising one octagonal section, four pentagonal sections, and ten quadrilateral sections.

5. A blank for a case convertible from a shipping configuration to a display configuration, the blank consisting of twelve polygonal sections defining a first end of the blank, a second end of the blank, and first and second sides of the blank, the first and second end of the blank each having a linear edge defined by three polygonal sections, the first and second sides of the blank each having a non-linear edge defined by four polygonal sections, and two polygonal sections form an interior of the blank; the first and second sides of the blank each extending between the first and second ends of the blank; and a single tear line extending from the first side of the blank to the second side of the blank, the single tear line for converting the case from the shipping configuration to the display configuration.

6. The blank of claim 5, wherein one of the polygonal sections forming each side of the blank is a pentagonal section, remainder of the polygonal sections of the blank are quadrilateral sections.

* * * * *